US007256805B2

(12) United States Patent
Mulhearn et al.

(10) Patent No.: US 7,256,805 B2
(45) Date of Patent: Aug. 14, 2007

(54) METHOD OF ADJUSTING STROBE LENGTH IN A THERMAL PRINTER TO REDUCE EFFECTS OF CHANGES IN MEDIA TRANSPORT SPEED

(75) Inventors: Chris Mulhearn, Wakefield, RI (US); James E. Shaw, III, Plainfield, CT (US)

(73) Assignee: Astro-Med, Inc., West Warwick, RI (US)

( * ) Notice: Subject to any disclaimer, the term of this patent is extended or adjusted under 35 U.S.C. 154(b) by 281 days.

(21) Appl. No.: 11/051,917

(22) Filed: Feb. 4, 2005

(65) Prior Publication Data

US 2006/0176358 A1 Aug. 10, 2006

(51) Int. Cl.
*B41J 2/00* (2006.01)

(52) U.S. Cl. ..... 347/188

(58) Field of Classification Search ..... 347/188, 347/218; 400/582, 583.2
See application file for complete search history.

(56) References Cited

U.S. PATENT DOCUMENTS 5,508,820 A 4/1996 Kabeya ..... 358/404
5,555,462 A * 9/1996 Fukumoto et al. ..... 347/218
5,657,066 A 8/1997 Adams et al. ..... 347/198
6,095,700 A 8/2000 Negishi et al. ..... 400/120.02
6,106,176 A 8/2000 Yanagisawa et al. .... 400/615.2
RE37,845 E 9/2002 Kamada et al. ..... 347/141
6,788,324 B2 * 9/2004 Fisher et al. ..... 347/188

* cited by examiner

*Primary Examiner*—K. Feggins
(74) *Attorney, Agent, or Firm*—Barlow, Josephs & Holmes Ltd

(57) ABSTRACT

A thermal printing apparatus and a method of controlling a thermal printing apparatus is provided wherein the duration of the strobe pulse utilized to transfer the ink from the carrier to the media is controlled and adjusted by a correction factor. The correction factor is calculated by the printer controller based directly on feedback regarding the actual transport time required to advance the media between encoder steps. Generally, the present invention controls a thermal printer in a manner that accounts for the transport speed between each encoder step and applies the correction factor to the strobe signal duration in a manner that maintains a uniform print density.

12 Claims, 8 Drawing Sheets

METHOD OF ADJUSTING STROBE LENGTH IN A THERMAL PRINTER TO REDUCE EFFECTS OF CHANGES IN MEDIA TRANSPORT SPEED

BACKGROUND OF THE INVENTION

The present invention relates generally to the area of thermal transfer printers. More specifically, the present invention relates to a thermal printer and a control process for thermal transfer printers that print on die-cut label media.

In general, the technology related to direct thermal and thermal transfer printers is well known in the prior art. Thermal transfer printers are designed for printing onto non-sensitized materials such as paper or plastic films. In the printing process, a transfer ribbon that includes a heat-transferable ink layer deposited on one side thereof is interposed between the media to be printed and a thermal print head that includes a row of very small, tightly spaced heater elements. To affect the transfer of the ink from the transfer ribbon to the media, an electrical pulse is applied to a selected subset of the heater elements within the printer head, thereby melting and transferring the ink adjacent the heater elements from the transfer ribbon onto the paper, resulting in a corresponding line of dots being transferred to the surface of the media. Since the print head is oriented horizontally with respect to the media, each time this process is repeated the printer prints one horizontal line onto the media. Generally in the art, thermal transfer printers also include more than one such thermal print head positioned adjacent and in spaced relation to one another, wherein each head corresponds to a separate color of ink. For example, many thermal transfer printers include either three heads for printing magenta, cyan and yellow inks or four heads for printing magenta, cyan, yellow and black inks.

In a similar fashion to the thermal transfer type printer, direct thermal printers print by utilizing small arrays of heaters to print directly onto sensitized materials. In a direct thermal printer, no transfer ribbon is used and the heater elements act directly with the sensitized media to produce chemical or physical change in a dye coating on the surface of the media. While the descriptions provided throughout this specification are directed primarily to thermal transfer printing, it should be appreciated that to the extent that similar features or constructions impact the printing process within other printing systems, those aspects of the present invention apply equally to equivalent technologies, such as those utilized in direct thermal printing.

After each respective line of dots is printed, the media is advanced slightly within the printer in order to position the print head over an adjacent location, the transfer ribbon is repositioned to expose a fresh coating of transfer ink and the heating process is repeated to print the next adjacent line of dots. Depending upon the number of print heads and the number of heaters on each print head, the printed arrays of dots can produce individual characters or images. Further, successive rows of dots are combined to form complete printed lines of text, bar codes, or graphics.

In order to print a coherent image, the printer must know at which points in time to activate the print head. Specifically, the printer needs to know the exact position of the media each time it activates the print head. In order to determine the position of the media relative to the print head, the printer utilizes an encoder that consists of a roller, which is engaged against the surface of the media. Every time the encoder roller rolls a specific amount, it sends an indexing signal to the print controller. Commonly the encoder is configured to notify the printer every time the media is advanced by $1/300^{th}$ of an inch. Accordingly, each time the print controller receives a signal from the encoder, the print controller knows that it must print another line, thereby resulting in a printed line on the media every $1/300^{th}$ of an inch.

It should be appreciated by one skilled in the art, that any particular ink transfer ribbon only has one ink on the transfer surface and accordingly is only capable of printing one shade of color no matter what heat intensity is utilized to transfer the ink from the ribbon to the media. Therefore, in order to create various shades or intensities of any given color, the printer utilizes a form of visual trickery known as half-toning. In the half-toning process, two approaches exist for varying the appearance of the dots in the printed output. In one approach, the printer controls the intensity of the heat utilized for the transfer of each of the individual ink dots to the media thereby controlling the actual size of each of the dots that are transferred. In this approach, as more heat is applied, a larger dot is produced and as less heat is applied, a smaller dot is generated. In a second approach, the printer divides the image into an array of virtual dots, each of which is formed from an array of individual pixels that each has a constant size. In this approach, the printer controls the size of the virtual dot by varying the number and pattern of pixels printed within the virtual dot. As can be appreciated, in this method, consistent dot size is critical to producing consistent print output. Accordingly, even though a thermal printer typically only has three colors, namely, magenta, cyan and yellow, any number of other colors can be created by overlying a half-tone print of each of the colors wherein the relative intensity level of each color is controlled by controlling the size of the dots by varying the heat to change the physical size of the dot or adjusting the number and pattern of pixels printed within a virtual dot. For illustration purposes, the following is a simple example of the half-toning process. Printing an image of solid magenta onto the media is easy because the printer includes a magenta transfer ribbon. All the printer has to do is fill the image on the media with magenta ink. When printing a light shade of magenta onto the media, the process becomes more complicated because the printer does not have a light magenta ribbon. To print a light magenta color, the printer must simulate it using the magenta print ribbon. Simulated lighter colors are created by controlling the size of the dots of magenta ink that are transferred, wherein the printer transfers relatively small dots (virtual or actual) of magenta ink and allows some of the original background color of the media to remain exposed. In this manner, the viewer's eye sees the mix of small magenta dots and the background color and perceives the overall mix as light magenta. To make an even lighter shade of magenta, the dots simply must be smaller in size thereby allowing more of the background color to show through the magenta ink. FIG. 1 more clearly illustrates the difference between a dark shade and a light shade transferred in this manner. Arrays of dots are shown wherein each dot is actually a virtual dot comprised of an array of individual pixels. The size of the dots illustrated in FIG. 1 has been exaggerated for clarity. Image 2 on the left has larger ink dots 4 where a large percentage of the pixels 5 within each of the virtual dots 4 are printed. Since the ink dots 4 cover more of the background color, the eye perceives this image 2 to be a dark shade. In contrast, image 6 on the right has smaller ink dots 8 where a smaller percentage of the pixels 9 within each of the virtual dots 8 are printed thus leaving more of the background color exposed and resulting in a perception of a lighter shade. When the printer prints the dots at the actual size of $1/300^{th}$ of an inch, the eye does not see the individual dots but interprets the image as one solid color in a desired tonal shade (either a light shade or dark shade).

The difficulty found in this prior art printing method is that minute changes in the transport speed of the media through the print head result in undesirable fluctuations in the print head temperatures between print cycles. These small speed changes translate to visible artifacts in the image. Such artifacts often appear as an uneven transfer of ink from line to line in the image. The problem is further exacerbated when media, commonly known as gap media, is printed. Gap media is a continuous feed roll of sheet label media that is applied to a thin backing or liner sheet. The labels are die-cut from the label media and the border surrounding the cut labels is removed to create a series of individual labels attached to a continuous roll of liner material. A common gap media, for example, consists of 4"×6" adhesive backed labels attached in series on a five-hundred (500) foot long roll of liner. The space between each of the labels is referred to as a gap. The particular feature of gap media that is problematic is that the leading edge of each label creates a lip that can catch on various mechanical parts on the interior of the printer. As the leading edge passes over and under the various mechanical parts of the printer, the speed of the media changes (typically slows), thereby further contributing to the creation of artifacts or uneven ink transfer.

It has been determined that while the actual interruption of the speed of the media may seem trivial when viewed in terms of actual transport speed, these minute interruptions result in visible banding within images. These bands are particularly pronounced when producing half-toned images. This problem can be better understood by reviewing a graph of the actual time spent printing and transporting the media relative to each count of the encoder. The graph shown in FIG. 2 details the relationship between the encoder count, which is represented along the X-axis 10 and the time in milliseconds spent printing a single line and advancing the media by $1/300^{th}$ of an inch, which is represented along the Y-axis 12. The graph represents actual data collected when printing 4"×6" labels having a continuous half-toned single color printed thereon. It is important to note that the graph does not represent media speed. Instead it represents the time period required to print a single line and advance the media one encoder step. In this particular graph, the printer was set to operate at a speed of 3 inches/second and a resolution of 300 lines per inch. Using these settings it follows that the printer operates by printing 900 lines/second, thereby requiring 1.111 milliseconds (mS) to print each line and advance the media to the next line. A review of the graph indeed confirms that the period between each encoder count falls generally between 1.1 mS and 1.2 mS.

What is more revealing about the graph however is that at fairly regular intervals, the time between encoder counts sharply jumps to nearly 1.4 mS. Further, in reviewing the particular locations of these extended line print times relative to the positioning of the media in the printer, there is a clear relationship between specific media positioning within the printer and the extended line print times. The portion of the graph between the bracket lines 14 and 16 represents the period of time wherein a sample label on the media roll was passing under the magenta print head. When comparing the peaks 15 that lie between the bracket lines 14, 16, it is clear that the peaks 15 correspond to physical positions on the printed label that are located 1.5", 3.1" and 4.4" into the label. A sample of the label 18 that was printed while collecting the data as found in the graph clearly demonstrates that there is in fact banding 20 that occurs at each of the locations predicted by the extended print time peaks 15 shown in the graph.

In determining the reason for the appearance of the banding 20, the relative positioning of the gap media must be reviewed as compared to the mechanical components of the printer itself. This relationship between the media and the elements of the printer is illustrated in FIG. 4. Specifically, four print heads 22*a*, 22*b*, 22*c* and 22*d* are schematically shown. Gap media is illustrated having a liner 24 and labels 18 thereon. To understand the reason that the bands appear, an understanding behind the operation of the actual print head is necessary. A thermal print head does not instantaneously cool down the moment after it operates to affect a transfer of ink. Each time a line is printed, residual heat from the previous line remains within the print head. Circuitry within each of the print heads allows the system to reach a steady state by accounting for the history of each line that was previously printed. The limitation is that this circuitry only considers historical residual heat data and assumes a linear cooling rate and that the transport of the media is occurring at a steady and constant pace. The problem as was shown in the graph of FIG. 2 is that the assumption that the media is being transported at a constant state is an incorrect assumption. In fact it is clear that the transport of the media actually encounters regularly spaced periodic slowdowns. The reason for these slow downs can be seen in FIG. 4. As a label 18 passes under a print head such as the magenta print head 22*d*, the leading edge of the label 18 at some point must encounter the next print head 22*c* in the printer sequence. Due to the nature of the gap media, the media layer surrounding the die cut labels 18 has been removed from the liner 24 as was discussed above. This media format results in a small lip along the advancing edge of the label 18 that is susceptible to catching against the next print head 22*c* which it encounters, thereby creating a small mechanical drag on the media transport, which in turn causes a sudden and brief change in media transport speed. This is clearly the reason for such a media slow down because the banding as illustrated in the graph and on the sample label corresponds exactly to the relative spacing of the adjacent print heads within the printer used for testing.

The difficulty with the prior art is that in practice it has been demonstrated that the assumption of a constant media transport speed is incorrect. The impact of this incorrect assumption is clearly the appearance of banding each time the media transport speed is suddenly changed for any reason. Any time the media transport is briefly slowed, the time between the printing of one line and the next line is increased. In some cases this delay can be significant. Consider that the steady state duration is 1.1 mS and that the extended durations can be as much as 1.5 mS, which translates into an increase of time of as much as 36% between printing of adjacent lines. This extended duration allows the print head to cool down for a longer period of time before printing the next line. Remember that in the prior art the assumption is a constant transport speed. Therefore, this additional time that the print head is allowed to cool is not accounted for in the print process. As a result, if there is an abrupt slowdown in the transport speed, less residual heat will be present in the head and the array of pixels in the virtual dots that are printed immediately following the slow down will be smaller, thereby producing a row of virtual dots and therefore a line that looks lighter. Similarly, if the transport speed is abruptly faster, more residual heat will be present in the print head and the array of pixels in the virtual dots that are printed immediately following the speed increase will be larger, producing a line that looks darker.

In the prior art, there have been solutions introduced that attempt to solve the problem of inconsistent print quality during ramp up to a print operation. This is particularly a problem for certain types of "one-off" printers that frequently are required to print a single label or a single batch of a few labels and then wait in stand-by mode for the next set of instructions. In these cases, the media transport must accelerate in order to print the first label and decelerate during the printing of the last label. When operating in such a fashion, if the printer waited to begin the printing operation until the media transport reached the presumed constant state velocity, several unprinted labels would be wasted at the beginning and end of each batch job. This is the problem stated in U.S. Pat. No. 5,657,066 (Adams). In Adams, the controller accounts for instantaneous velocity during acceleration and deceleration and adjusts the pulse width of the strobe signal to maintain uniform print density during ramp-up and ramp-down periods at the beginning and end of each batch print job. However, the system in Adams still utilizes an assumption of smooth and consistent transport performance. Specifically, Adams assumes a constant acceleration, a constant state transport speed and a constant deceleration. Further, while Adams adjusts the print controller during acceleration and deceleration, it reverts to a constant transport speed assumption during normal operation. Accordingly, the Adams reference lacks the ability to overcome the periodic and subtle inconsistencies as identified above.

There is therefore a need for a thermal printer that includes a means for detecting minor and instantaneous changes in the transport speed of the media that is being printed and adjusting the printer strobe signal relative to such changes. Further, there is a need for a manner in which to control a thermal printer that detects and adjusts printer strobe signal durations instantaneously, based on precise feed back relative to actual media transport speeds between each encoder step thereby maintaining a reliably constant size for each and every printed pixel.

BRIEF SUMMARY OF THE INVENTION

In this regard, the present invention provides a thermal printing apparatus and a method of controlling a thermal printing apparatus wherein the duration of the strobe pulse utilized to transfer the ink from the carrier to the media is controlled and adjusted by a correction factor which is calculated for each printed line and related directly to feedback regarding the actual transport time required to advance the media between encoder steps. The general purpose of the present invention, which will be described subsequently in greater detail, is to control a thermal printer in a manner that accounts for the transport speed between each encoder step and applies a correction factor to the strobe signal duration in a manner that maintains a uniform print density and insures a constant size printed pixel thereby maintaining consistent virtual dots.

In a thermal printer, the print heads are designed to operate at a specific voltage and therefore cannot be "turned up" more than a constant state. In order to make larger or smaller virtual dots, the printer prints an array of more or less pixels within each of the virtual dots. It is important therefore, as stated above, that each pixel be of a highly consistent and predictable size so that the virtual dots have a uniform appearance. Therefore, in order to compensate for instantaneous changes in media speed, the present invention records the time between each successive signal generated by the encoder. The time value obtained from the encoder is compared to the assumed constant state time value and a correction factor is calculated and then applied to the strobe length. The correction factor serves to scale the strobe duration in an amount that is proportional to the detected change in media transport speed. Throughout the entire print job, a moving average value is maintained for the constant state time factor and this moving average value is used as the comparison base line value by which deviations are identified, thereby triggering the application of a strobe length correction factor.

This manner of control actually serves to identify and compensate for a number of different problems related to media transport speed and is not just limited to the horizontal banding illustrated above with regard to gap media. For example, the present invention also serves to overcome the wavy appearance that occurs as the result of running thermal printers at their lowest speed setting, where the low frequency of the stepper motor that transports the media results in a ratcheting of the media transport speed. The correction factor in this case serves to detect and compensate for the varying speed of the stepper motor.

It is therefore an object of the present invention to provide a thermal printer apparatus that maintains a constant print quality in response to instantaneous variations in media transport speeds. It is a further object of the present invention to provide a thermal printer apparatus that monitors the transport speed of the media being printed and adjusts the print strobe signal based on variations in the transport speed to maintain constant print density. It is yet a further object of the present invention to provide a thermal printer apparatus that detects the actual media transport speed and generates a strobe length correction factor that is proportional to the difference detected between the actual media transport speed and the presumed constant state transport speed. It is an even further object of the present invention to provide a control feed back loop for a thermal printer apparatus that detects the actual media transport speed, compares the actual transport speed to a predicted constant transport speed, generates a strobe length correction factor that is proportional to the difference detected between the actual media transport speed and the presumed constant state transport speed and applies the correction factor to the strobe signal duration to maintain a constant and predictable print density.

These objects, together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
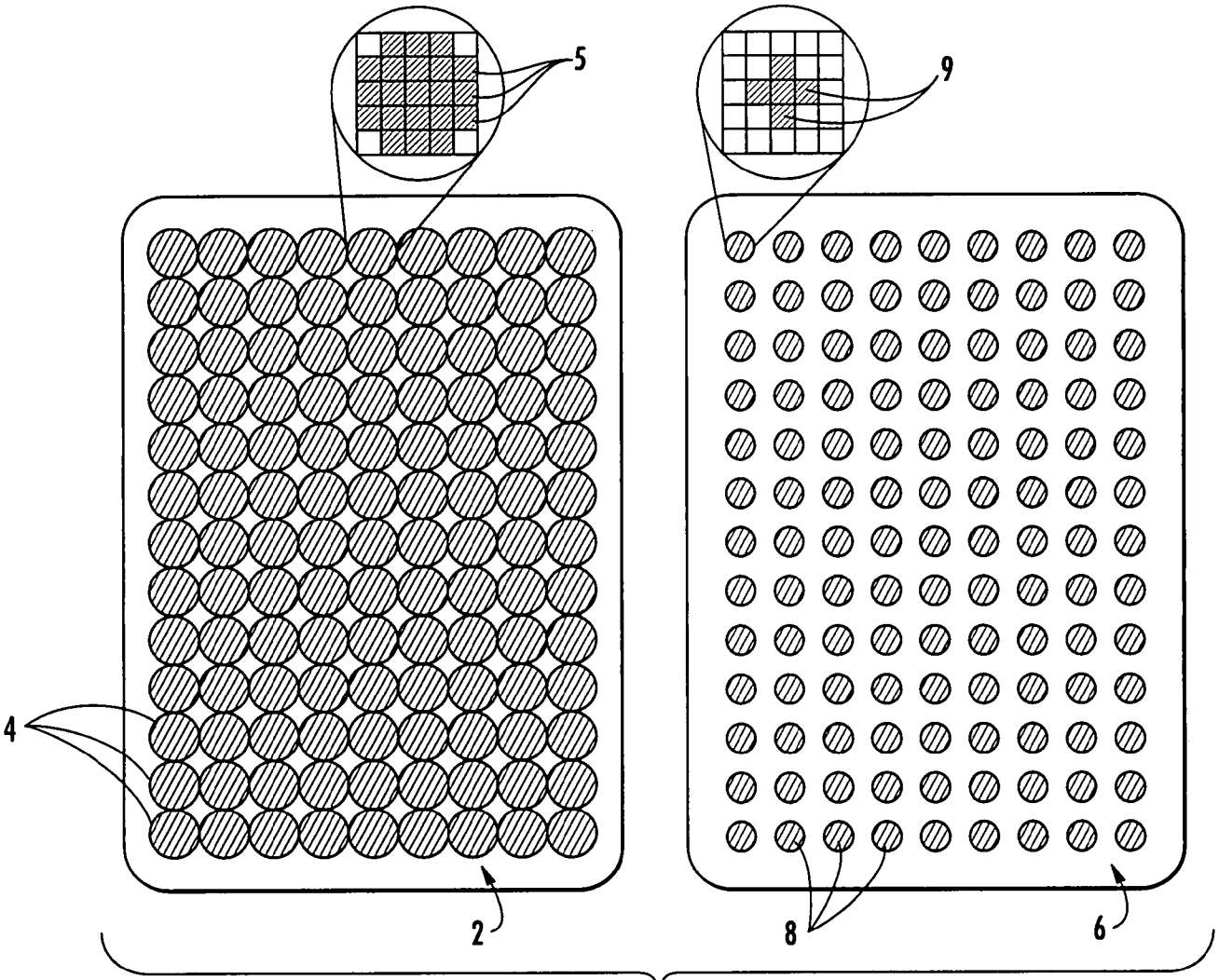
FIG. 1 is an enlarged view of the dots printed utilizing a half-tone printing method.

Now referring to the drawings, the state of the present art and the principals of the present invention are shown and generally illustrated in the figures. As was discussed earlier, the present invention is directed to a thermal printing apparatus and a method of controlling a thermal printing apparatus in a manner that maintains highly consistent print density and thus provides improved print quality. FIG. 1 illustrates the general principals associated with thermal printing technology. Thermal printers include a limited number of available color ribbons from which to generate a printed image. Generally, these ribbons include the following colors: cyan, magenta, yellow and occasionally black. To create varying shades of these colors, or to create other colors, the printer utilizes various combinations of the available colors in varying intensities in overlying relation. Further, since only one shade of each color is available for use in the printer, the printer utilizes a process referred to as half-toning, whereby the transferred dots of color are printed in different sizes depending on the intensity of the color desired. Accordingly, as is seen in FIG. 1, the printed image 2 on the left was printed using large virtual dots 4 consisting of a relatively large array of pixels 5. As can be seen, the virtual dots 4 cover a higher percentage of the background thereby providing a darker appearance to the overall image. The printed image 6 on the right was printed using smaller virtual dots 8 consisting of a relatively small array of pixels 9 that cover a smaller percentage of the overall background resulting in a lighter appearance to the overall image. To vary the size of the dots, thereby changing the shade of the printed image, the printer simply controls the number and pattern of pixels printed in each of the virtual dots. Higher pixel densities produce larger virtual ink dots and lower pixel densities produce smaller virtual ink dots. However, to produce a predictable and consistent result, the size of every pixel printed must be carefully controlled and maintained so that the resultant virtual dot appears as intended. With this particular printing method in mind, it can be appreciated by one skilled in the art that any slight change in the size of the pixels translates to a change in density of the printed virtual dots that is perceived by the viewer of the image as a printed image having a slightly different shade than an image having either larger or smaller virtual dots.

Figure 2:
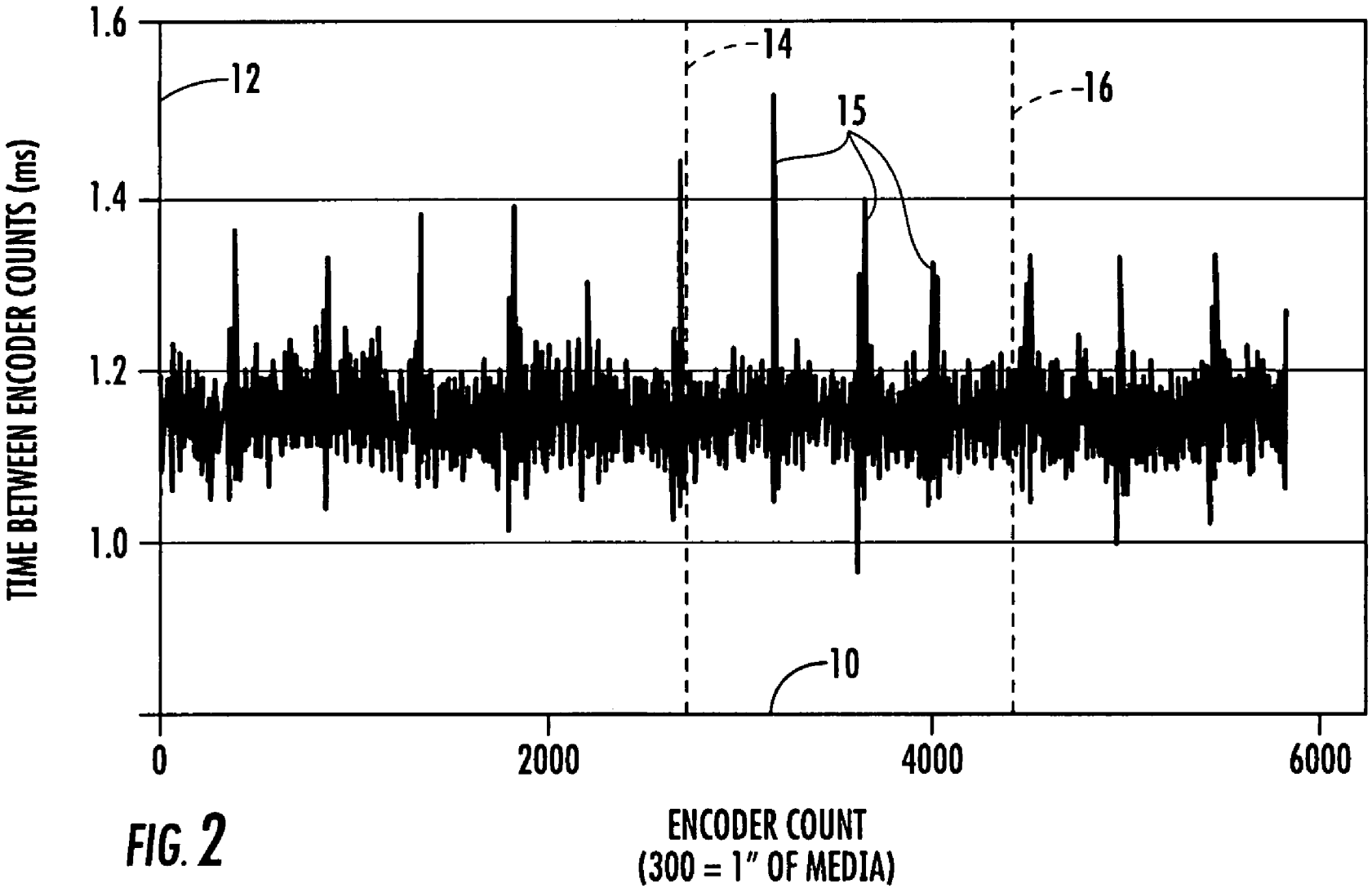
FIG. 2 is a graph illustrating actual data collected while printing media, illustrating the actual time recorded between each encoder step.
Figure 3:
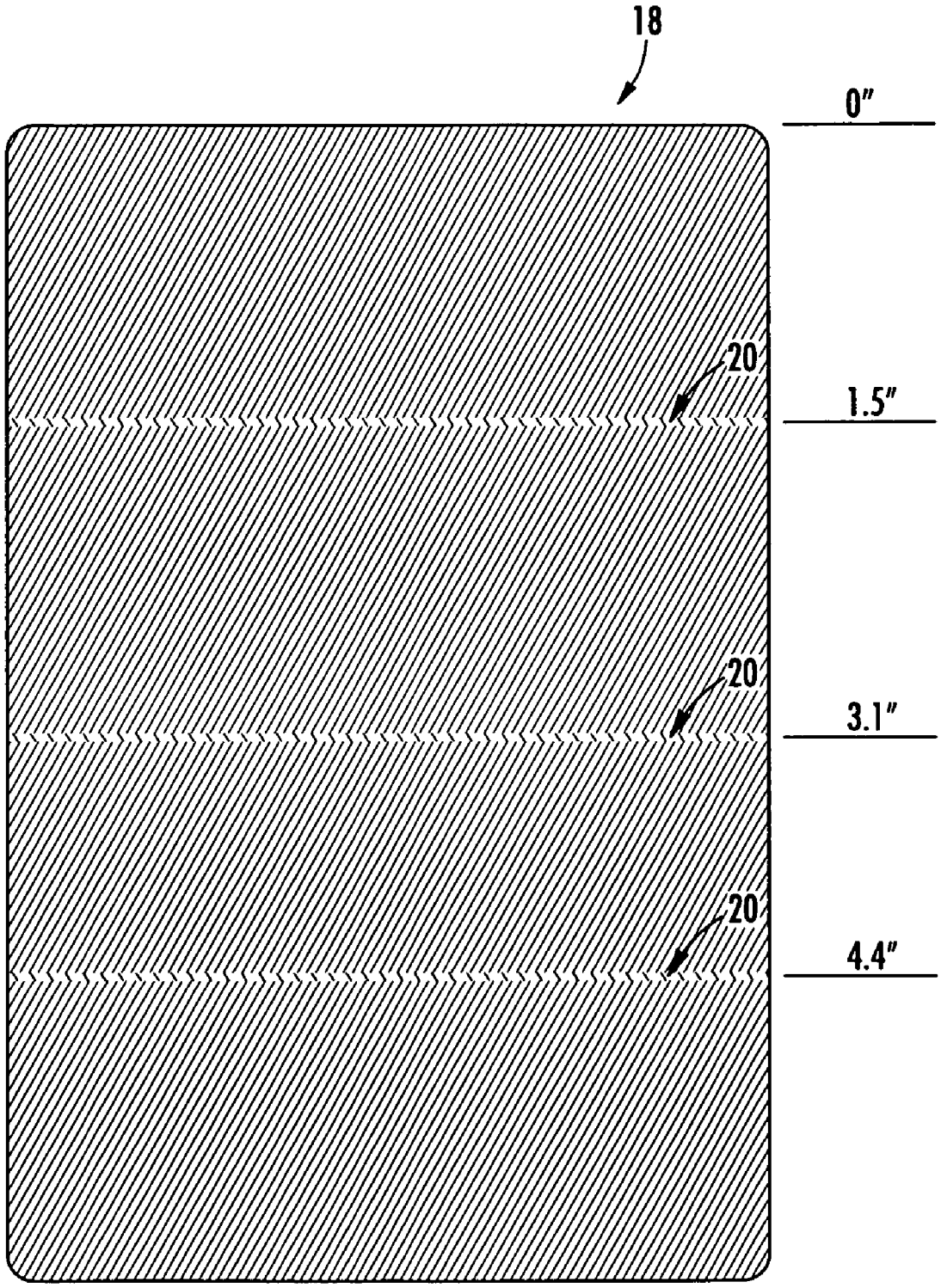
FIG. 3 is an illustration depicting an actual printed label.

As was discussed in detail above, the most desirable manner for producing consistent shaded images is to have a predictable and constant media transport speed during the printing process. As long as the media transport speed is constant and the time between advancing the media and the printing of each subsequent line is the same, the residual heat in the print head and the required strobe duration for the desired ink transfer is predictable. However, it has now been identified that the transport speed is not constant. This phenomenon is illustrated in the graph depicted in FIG. 2. Within the graph, several peaks 15 of relatively long transport times can be seen. Each one of these peaks 15 represent a 25%-35% increase in time elapsed between printing of adjacent lines in a printed image. These increased durations in transport time are not compensated for in the prior art because the transport speed of the media is assumed to be uniform. The problem, as described in the background, is that when the transport speed is not constant, the print head has a longer duration over which to dissipate residual heat, thereby impacting the overall heat available in the print head during the next line printing operation. This can be clearly seen in FIG. 3 wherein banding 20 occurs in the image 18 corresponding to a line that is printed immediately after one of these peaks 15 as seen within the graph in FIG. 2. In short, a longer transport duration between printing of adjacent lines results in lighter shade printed line.

Figure 4:
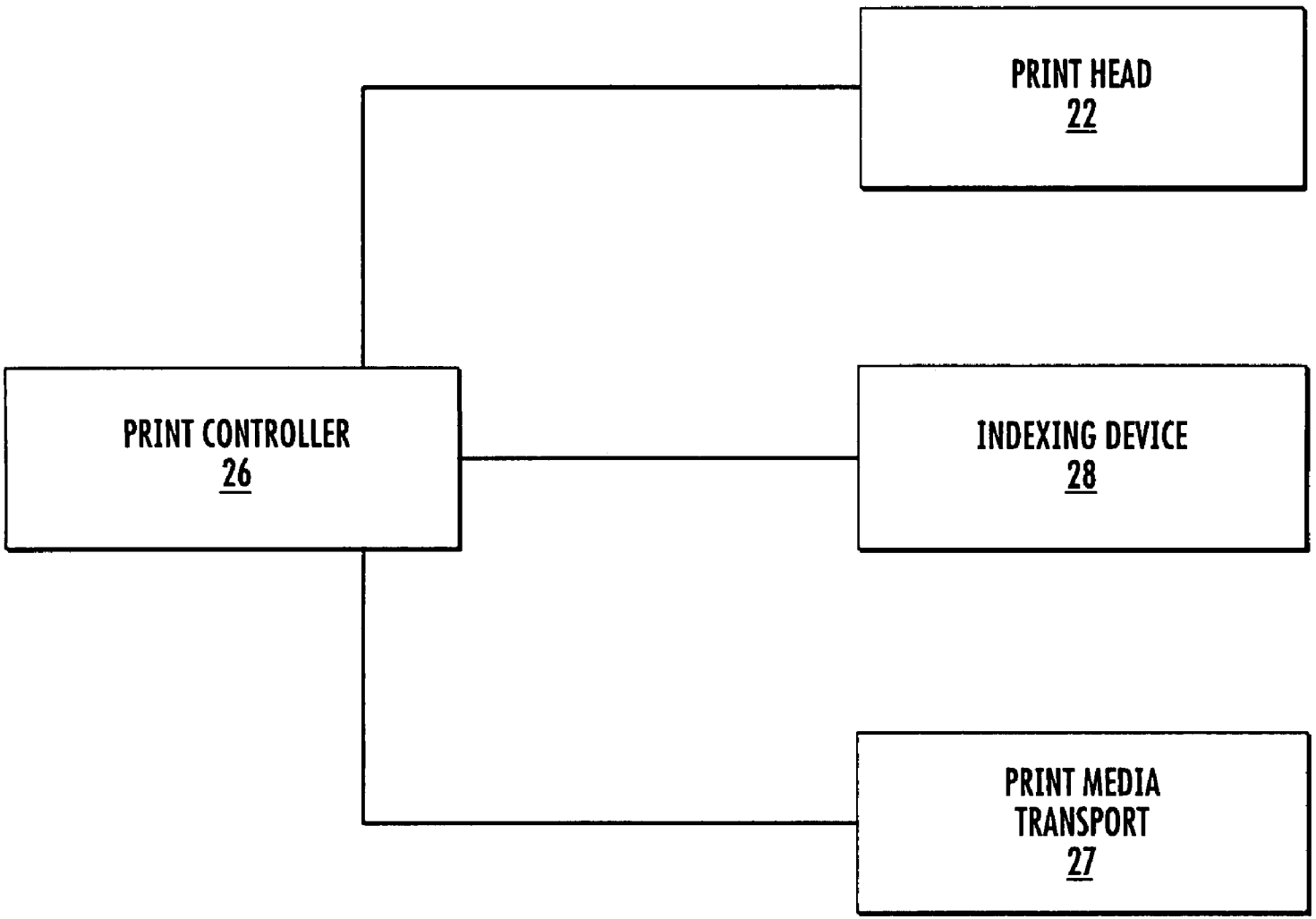
FIG. 4 is a schematic block diagram of the relationship between control components of a thermal printer.

FIG. 4 is a schematic block diagram illustrating the relationship between the control components of a thermal printer apparatus. Specifically, the typical components include a print controller 26, at least one print head 22, an indexing device, which is normally referred to as an encoder 28, and a print media transport assembly 27. The print controller 26 is in electronic communication with each of the at least one print head 22, the transport assembly 27 and the encoder 28. In this manner, the print controller 26 can monitor and direct the operation of the entire printing process.

Figure 4A:
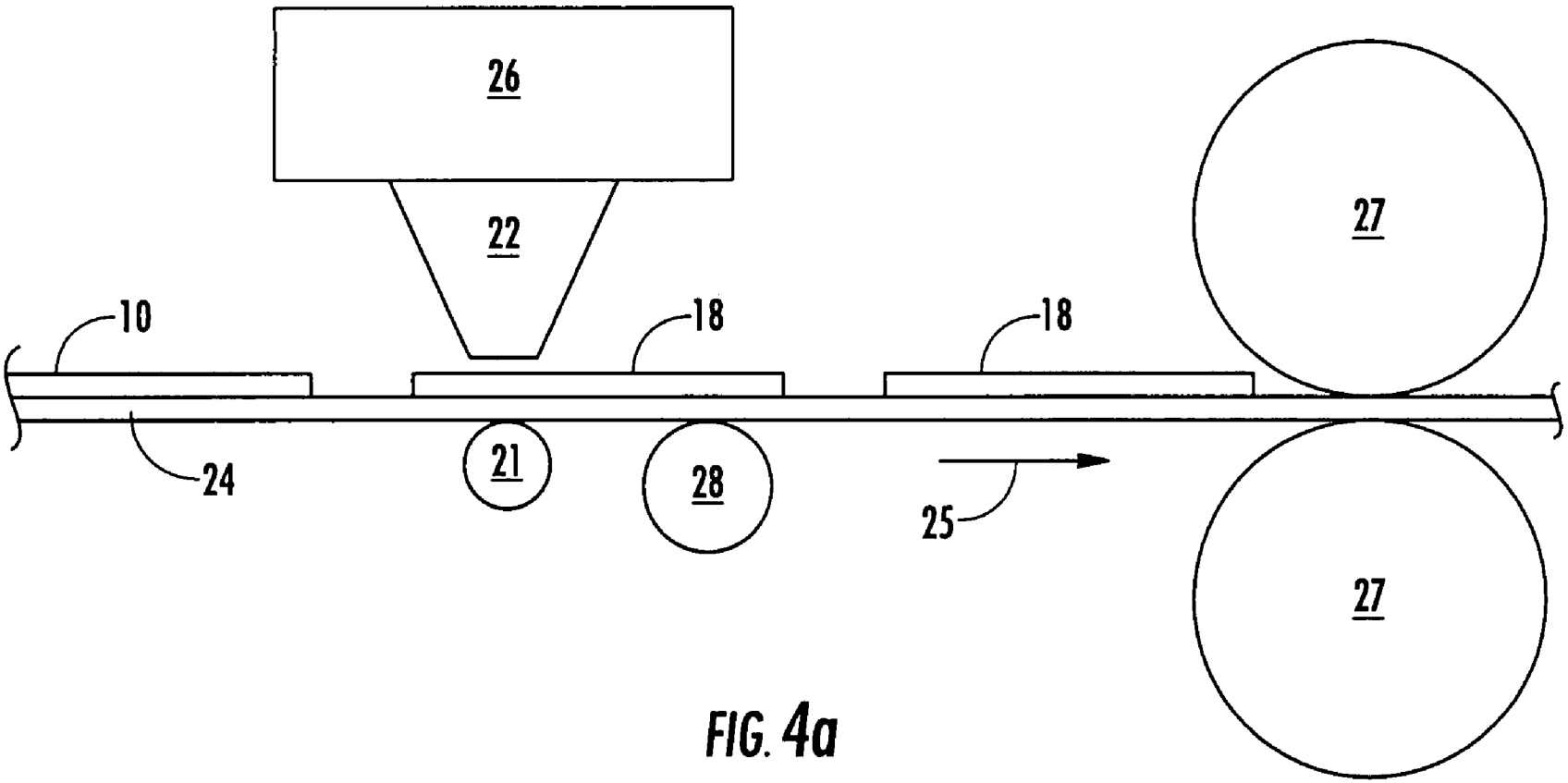
FIG. 4*a* is a diagrammatic view of a typical prior art monochrome thermal printer apparatus.

FIG. 4*a* is a schematic illustration of the simplest form of direct thermal or monochrome transfer printing apparatus. This simplified apparatus provides a clear illustration as to one reason that periodic changes in transport occur. The apparatus minimally includes a media that is drawn through the apparatus by drive rollers 27 in a feed direction indicated by the arrow 25. An encoder 28 monitors the movement of the media as it advances and sends a periodic signal to the print controller 26 based on movement of the media. Based on the encoder signal, the print controller 26 instructs the print head 22 to print a line onto the media. A platen roller 21 is shown below the media, adjacent the print head 22, to maintain contact between the print head 22 and the media. As can be seen, as the media includes labels affixed to the carrier film 24, wherein the media is advancing in the direction of the arrow 25. As the media advances, the leading edge of a die cut label 18 impacts the side of the drive rollers 27. When this impact occurs, the media transport speed is slightly slowed while the drive rollers 27 overcome the resistance encountered as the leading edge of the label 18 passes therebetween. This slowdown causes a slightly longer duration between printing of adjacent lines at print head 22. This extended duration between printing adjacent lines allows the print head 22 to cool more than is predicted between printing of adjacent lines, thereby causing a subsequently lighter line to be printed during the next print cycle.

Figure 4B:
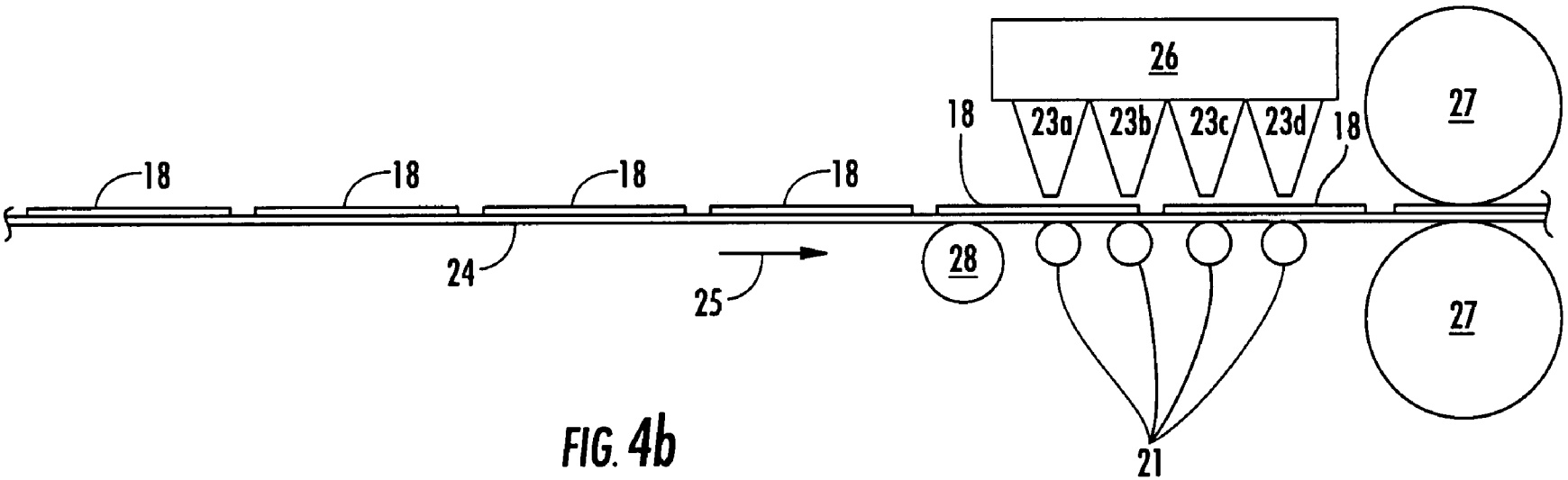
FIG. 4*b* is a diagrammatic view of a typical prior art color thermal printer apparatus.

Similarly, FIG. 4*b* schematically illustrates a thermal transfer color printer. The printer includes a media that is drawn through the apparatus by drive rollers 27 in the direction indicated by the arrow 25. The encoder 28 monitors the movement of the media as it advances and sends a periodic signal to the print controller 26, and in turn to the print heads 23*a*, 23*b*, 23*c* and 23*d* based on movement of the media. The print heads 23*a*, 23*b*, 23*c* and 23*d* each include a color of transfer ink loaded therein. Typically the ink colors loaded into the printer would include cyan, magenta, yellow and black. Further, these colors are normally loaded by placing cyan on print head 23*a*, magenta on print head 23*b*, yellow on print head 23*c* and black on print head 23*d*.

Clearly, this order is not critical to the function of the present invention and altering the order of the ink color relative to the respective heads would not serve to remove an equivalent device from the scope of the present disclosure. Each time the media advances a sufficient distance, as measured by the encoder 28, the encoder 28 signals the print controller 26 and in turn the print heads 23*a*, 23*b*, 23*c* and 23*d* to print the next line in the print job. As can be seen, the media includes labels 18 affixed to the carrier film 24, wherein the media is advancing in the direction of the arrow 25. As the media advances, the leading edge of a die-cut label 18 in this illustration approaches print head 23*b*. As first the gap between the labels 18 on the carrier film 24 passes between the print head 23*b* and the platen roller 21 located therebeneath, the platen roller 21 and the print head 23*b* squeeze together to accommodate the reduced thickness in the media. This pinching then results in the leading edge of the label 18 impacting the side of the print head 23*b* as the platen roller 21 and print head 23*b* must again adjust to the increased thickness of the media following the gap between labels 18. When this impact occurs, the media transport speed is slightly slowed while the leading edge of the label 18 passes beneath the print head 23*b*. This causes a slightly longer duration between the printing of adjacent lines by each of the print heads 23*a*, 23*b*, 23*c* and 23*d*. This extended duration between printing adjacent lines allows the print heads 23*a*, 23*b*, 23*c* and 23*d* to cool more than is predicted between printing of adjacent lines, thereby causing a subsequently lighter line to be printed on the surface of the labels 18 at the present location corresponding to each of the print heads 23*a*, 23*b*, 23*c* and 23*d* during the next print cycle. It should be appreciated that the pinching of the media occurs as each gap between the labels 18 passes between each print head 23*a*, 23*b*, 23*c* and 23*d* and their respective platen rollers 21. Similarly, a slow down in transport speed may occur as the result of a variety of other mechanical impacts that are encountered along the transport path within the apparatus.

Figure 5:
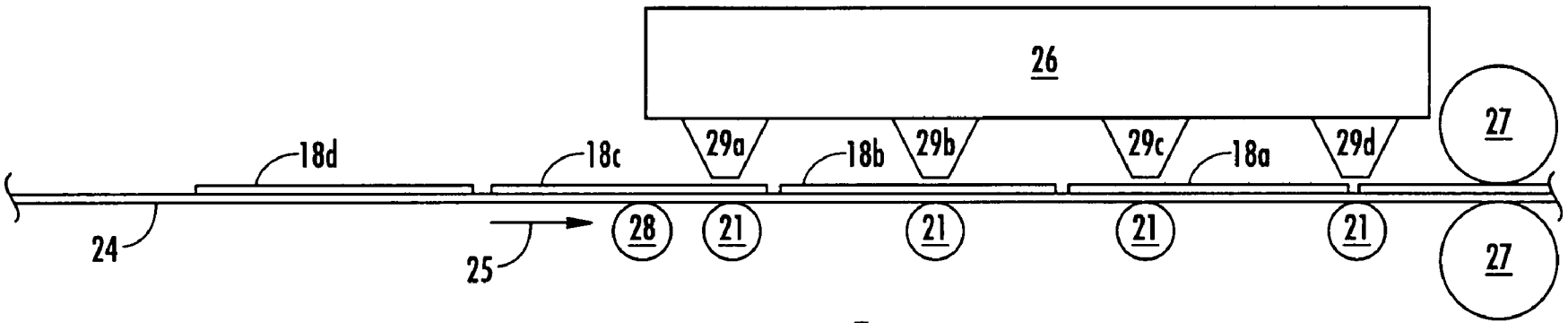
FIG. 5 is a diagrammatic view of a thermal printer apparatus illustrating the principal elements of the present invention.

Turning now to FIG. 5, the apparatus of the present invention is shown and schematically illustrated with the proper proportional spacing between each of the operative elements. The apparatus of the present invention generally includes a media that is drawn through the apparatus by drive rollers 27 in the direction indicated by the arrow 25. The encoder 28 monitors the movement of the media as it advances and sends a periodic signal to the print controller 26 and in turn to the print heads 29*a*, 29*b*, 29*c* and 29*d* based on movement of the media. The print heads 29*a*, 29*b*, 29*c* and 29*d* each include a color of transfer ink loaded therein and platen rollers 21 positioned adjacent each of the print heads 29*a*, 29*b*, 29*c* and 29*d* to maintain contact between the print heads 29*a*, 29*b*, 29*c* and 29*d* and the media. The carrier film 24 is placed into the printing apparatus with gap media such as die-cut labels 18 thereon for printing. While die-cut gap media is discussed herein, it should be appreciated that the present invention applies equally to any type of media to be printed. The general concept is related to a thermal printing apparatus having a novel control system for improving the quality of the printed output and is not restricted to the specific media being printed therein.

As shown in FIG. 5, the apparatus of the present invention generally includes an array of printer heads 29*a*, 29*b*, 29*c* and 29*d*, a controller 26 and an encoder 28. Further, drive rollers 27 serve to draw the media thought the printer apparatus and platen rollers 21 located adjacent the print heads 29*a*, 29*b*, 29*c* and 29*d* serve to maintain the media in contact with the print heads 29*a*, 29*b*, 29*c* and 29*d*. It can be appreciated that the disclosure in FIG. 5 is schematic in nature and various other components related to a complex thermal printer have been omitted as not being particularly relevant to the apparatus and method of the present invention and therefore not considered necessary to illustrate the concepts disclosed herein.

Generally, as in the prior art, the apparatus of the present invention receives and indexes the media once it is installed into the apparatus. The encoder 28 functions to index the media and track the position of the media as it is advanced through the apparatus. The encoder 28 is configured to generate a signal each time the media is moved by a specified distance. Specifically, the encoder 28 generates a signal each time the media advances a distance that is equal to the resolution at which the image is being printed. For example, if the resultant image is being printed at a factory preset resolution of 300 dots per inch (dpi), wherein the printer is configured to print 300 lines for every inch of media printed with each line including 300 dots per inch of line, the encoder 28 is set to generate a signal every time the media advances $1/300^{th}$ of an inch. Similarly, if the factory present resolution was at 600 dpi, the encoder 28 would generate a signal every $1/600^{th}$ of an inch. In the present invention however, in contrast to the prior art, the controller 26 not only waits for a signal from the encoder 28 indicating that the media has been advanced by a specified distance, the controller 26 also tracks the exact time elapsed between each signal received from the encoder 28. The controller 26 then utilizes both the signal from the encoder 28 and the elapsed time between the signals, as will be discussed in detail below, to issue a print command to the print heads 29*a*, 29*b*, 29*c* and 29*d*. This can be clearly contrasted to the prior art wherein the only information utilized by the controller was the media advance signal received from the encoder 28.

In generating the print command that is sent to the print heads 29*a*, 29*b*, 29*c* and 29*d*, the controller 26 then performs a calculation to compare the actual media transport speed required to advance the media by one line to a predicted transport speed to determine a correction factor that must be applied to the print command. As was stated above, the only variable that can be controlled in the print command in order to vary the size of the pixel that is transferred is the duration of the strobe signal. Accordingly, the controller 26 utilizes both the encoder 28 signal and the duration between the encoder 28 signals to create a correction factor that is then applied to the strobe length to proportionally correct the length that the strobe is activated based on the measured factors. The controller 26 utilizes the following formula to determine a correction factor that in turn produces a revised strobe activation duration:

$$\text{Duration}_{new}=\text{Duration}_{old}*\{1+[((T_{cur}-T_{last})-P_{avg})/P_{avg}]*K\}$$

where $\text{Duration}_{new}$ represents the new strobe activation duration $\text{Duration}_{old}$ represents the original unmodified strobe activation duration $T_{cur}$ represents the recorded time elapsed before receiving the latest index signal from the encoder $T_{cur}$ represents the recorded time elapsed between the previous index signal from the encoder $P_{avg}$ represents the average time between encoder index signals K represents an empirically determined coefficient In this manner the controller 26 applies the above formula before printing each line of the image to determine the required strobe signal duration necessary to maintain uniform print quality. Any variations in the actual transport time between each encoder 28 signal is tracked to determine the actual time that the print head itself had been allowed to cool between print cycles, thereby allowing the strobes to be activated for a precisely determined period of time in order produce the desired pixel transfer size. Specifically, this feed back formula allows the controller 26 to precisely predict the conditions within the print head itself based on the encoder signal and the actual elapsed time between signals. To further enhance the precision of the correction factor generated by the controller 26, the average time between encoder 28 signals in maintained as a running average. By allowing this average to vary upwardly or downwardly as the general print speed of the printer itself varies, the strobe signal can be fine tuned to account for the exact speeds at which the media is being transported. In this manner, the controller 26 can track the larger overall trends in media transport speed to which the outlying transport speed variations can be compared. Finally, the constant K within this equation is a factor that is completely reliant on the particular printer into which the controller will be installed. The constant K is empirically determined based on all of the various operating factors of the particular printing device and must be determined on a case by case basis, or at least based on a specific type or model of printer device. The main factor that is considered when determining the K value for a given printer is the thermal property of the print head itself. Specifically, the K value varies based on how quickly or slowly the print head dissipates residual heat. In order to determine the given K value for a printer, the value is increased in 1/32 increments until the desired printed output result is achieved. In a printer that quickly dissipates residual heat, such as an AstroMed model 8100Xe printer that includes a water cooled head, the K value is 11/32 or 0.34375. In a printer that dissipates heat more slowly, such as a 4100XE printer manufactured by AstroMed having an air cooled head, the K value is 20/32 or 0.625. Similarly, given the key factors in printer construction and the examples identified above, one skilled in the art can easily utilize the disclosure of the present invention to determine the required value of K in order to apply the present invention to any variety of printer apparatuses.

Accordingly, in this particular printer apparatus, as the media advances through the printer in the direction of the arrow 25, various conditions cause mechanical impacts to occur that result in brief slowdowns in media transport speed. As is clearly illustrated in FIG. 5, the leading edge of label 18*a* is shown to be passing between print head 29*d* and its respective platen roller 21. As stated above, when the gap between the labels 18 pass between the print head 29*d* and the platen 21, the platen and print head 29*d* squeeze together. Immediately following this pinching of the media, the leading edge of label 18*a* must pass between the print head 29*d* and the platen roller 21 resulting in a mechanical impact between the leading edge of the label 18 and the print head 29*d*. This impact briefly slows the transport speed of the media allowing the print heads 29*a*, 29*b*, 29*c* and 29*d* to dissipate more residual heat than was anticipated in the constant transport rate assumption and causes the next lines printed by each of print head 29*c* on label 18*a*, print head 29*b* on label 18*b* and print head 29*a* on label 18*c* to be lighter than intended. A similar situation arises each time the leading edge of a label 18 passes through a mechanical restriction. For example, in FIG. 5, it can be seen that such a situation will arise as the leading edge of label 18 a passes between the drive rollers, as the leading edge of label 18*b* passes beneath print heads 29*c* and 29*d*, etc. These various mechanical impacts result in the generation of distinct banding within printed output that occur at predictable and measurable locations on the labels that correspond to the relative positioning between the various mechanical impact regions and the various print heads associated with each of the printed lines that include the banding artifact.

Figure 6:
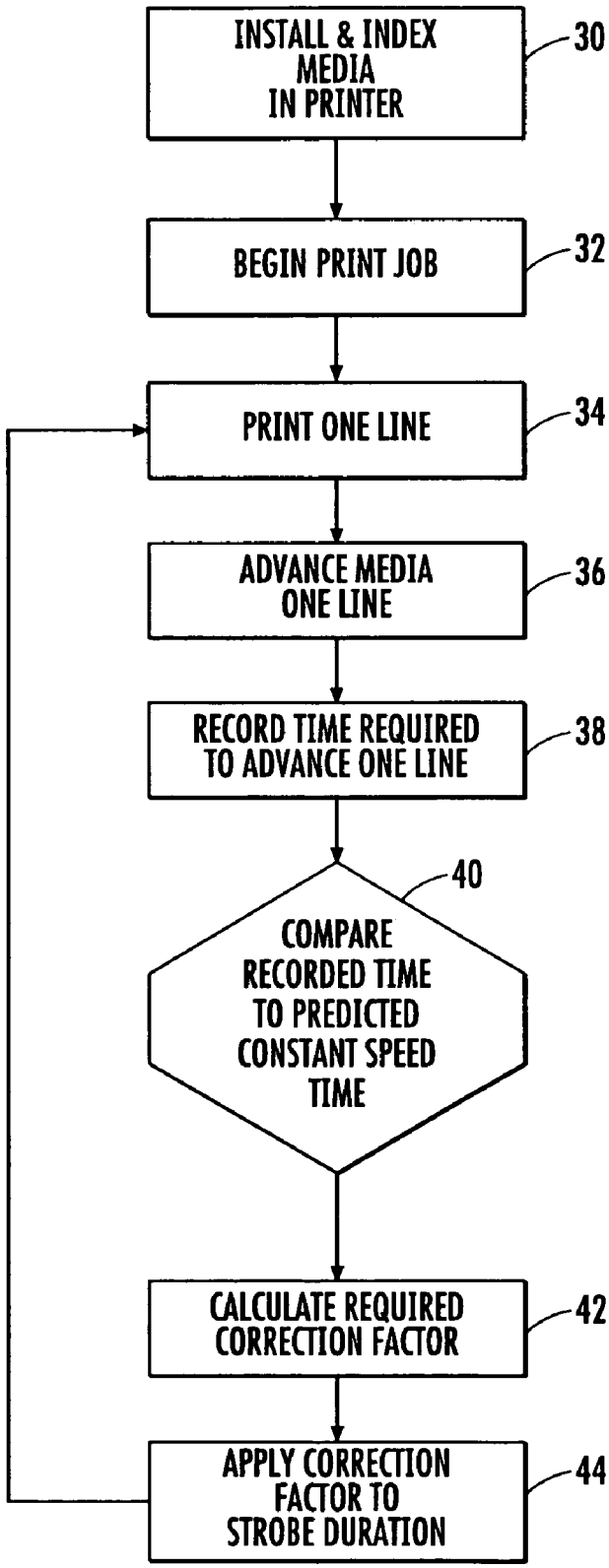
FIG. 6 is a flow chart detailing the process of the present invention.

Turning now to FIG. 6, a flow chart illustrating the control method for application in controlling the printing algorithm apparatus in FIG. 5 is shown. While this method will be described in the context of the apparatus shown in FIG. 5, is should be clear that the control method is equally applicable in any thermal printer that experiences transport speed interruptions. While the first step in the control process is illustrated as installing and indexing the media into the printer 30, it can be appreciated that once a printer is set up and calibrated, this particular step 30 will not always be required as media will already be loaded into the printer and the printer will be aligned. Next, instructions are sent to the printer to begin the print job 32. Once the printer receives the instruction to begin a print job 32 it starts the job by printing the first line 34. In the context of the actual printer, the controller 26 sends a signal to begin the print job wherein the print heads 29*a*, 29*b*, 29*c* and 29*d* are instructed to print the first line onto the labels 18. Next, as stated above, the printer advances the media by a single step 36 wherein the encoder 28 sends a signal to the controller 26 that the media has been advanced. Immediately after the media is advanced in the preceding step 36, the controller 26 records the time 38 required between encoder 28 signals. Specifically, the controller 26 is recording the interval required to print a line and advance the media therefore giving the printer feedback regarding the specific length of time that the printer head is idle between the printing of adjacent lines. The recorded time is then used by the controller 26 to calculate a correction factor 42 based on the amount that the recorded time deviates from a predicted transport time constant 40, utilizing the formula provided above. The correction factor is then applied to the original strobe length to generate a time-corrected strobe length 44 and the printer repeats the line print step 34 to print the next line by sending a print signal to the print heads 29*a*, 29*b*, 29*c* and 29*d* that includes the necessary correction factor. The entire process is repeated line by line by printing the line using a correction that is based on the actual transport speed. If the transport speed remains constant between steps, the factor may approach a negligible or zero adjustment. If there is a deviation in the transport speed, the correction factor as calculated in step 42 will be sufficient to compensate for the transport speed aberration for each line in the print job until the entire print job is completed. Accordingly, the controller 26 is able to account for each and every variation in transport speed and adjust the next print command sent by the controller 26 to customize the printing of each line.

It can therefore be seen that the present invention provides a novel thermal printing apparatus and method of controlling a thermal printing apparatus that utilizes a time-based correction factor that facilitates higher precision control over the printed result. Further, the present invention facilitates control of a thermal printing process that enables the printer to overcome any intermittent variations in the transport speed of the media without introducing inconsistencies into the resultant printed image. For these reasons, the present invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A thermal printer assembly comprising:

at least one print head for printing an image on a receptor surface of a print media;

a print media transport device configured and arranged to advance said print media;

an indexing device configured and arranged to measure advancement of said print media, said indexing device being operative for generating an index signal each time said print media is advanced a predetermined distance; and a control device, in electronic communication with said indexing device and said print head, said control device being configured and arranged to receive said index signal from said indexing device, to track an elapsed time between receipt of each of said index signals and to generate a print signal responsive to said index signal, said print signal having a print head activation duration that is proportionally corrected in overall activation length responsive to said elapsed time between sequential index signals, said at least one print head being configured and arranged to receive said print signal and to print an image responsive to said print signal.

2. The thermal printer assembly of claim 1, wherein said control device proportionally corrects said duration of said print signal using the following formula:

$$\text{Duration}_{new}=\text{Duration}_{old}*\{1+[((T_{cur}-T_{last})-P_{avg})/P_{avg}]*K\}$$

where $\text{Duration}_{new}$ represents the new strobe activation duration $\text{Duration}_{old}$ represents the original unmodified strobe activation duration $T_{cur}$ represents the recorded time elapsed before receiving the latest index signal from the encoder $T_{cur}$ represents the recorded time elapsed between the previous index signal from the encoder $P_{avg}$ represents the average time between encoder index signals K represents an empirically determined coefficient.

3. The thermal printer assembly of claim 1, wherein said thermal printer assembly is an ink transfer thermal printer.

4. The thermal printer assembly of claim 1, wherein said thermal printer assembly is direct thermal printer.

5. The thermal printer assembly of claim 1, wherein said indexing device sends an index signal to said controller each time said media is advanced by a distance corresponding to a predetermined print resolution setting.

6. The thermal printer assembly of claim 5, wherein predetermined print resolution setting is $1/300^{th}$ of an inch.

7. A controller for a thermal printer assembly comprising:

a control device, in electronic communication with at least a print media transport device, an indexing device and at least one print head, said control device providing a media transport signal to said media transport device to advance a print media, said control device being configured and arranged to receive said index signal from said indexing device, said control device tracking an elapsed time between receipt of each sequential index signals and generating a print signal responsive to said index signal, said print signals having a print head activation duration, said print head printing indicia on said media in response to said print signals, wherein said control device adjusts an overall activation length of said print head activation duration of each print signal proportionally relative to said elapsed time between index signals.

8. The controller for a thermal printer assembly of claim 7, wherein said control device adjusts said duration of said print signal using the following formula:

$$\text{Duration}_{new}=\text{Duration}_{old}*\{1+[((T_{cur}-T_{last})-P_{avg})/P_{avg}]*K\}$$

where $\text{Duration}_{new}$ represents the new strobe activation duration $\text{Duration}_{old}$ represents the original unmodified strobe activation duration $T_{cur}$ represents the recorded time elapsed before receiving the latest index signal from the encoder $T_{cur}$ represents the recorded time elapsed between the previous index signal from the encoder $P_{avg}$ represents the average time between encoder index signals K represents an empirically determined coefficient.

9. The controller for a thermal printer assembly of claim 7, wherein said indexing device sends an index signal to said controller each time said media is advanced by a distance corresponding to a predetermined print resolution setting.

10. The controller for a thermal printer assembly of claim 9, wherein predetermined print resolution setting is $1/300^{th}$ of an inch.

11. A method of controlling a thermal printer assembly comprising the steps of:

providing a thermal printer assembly including at least a control device, a media transport device, an indexing device and at least one print head, each of said media transport device, indexing device and at least one thermal print head electronically coupled to said control device;

placing media to be printed into said media transport assembly, said media transport assembly configured and arranged to advance said print media;

sending a print signal having a print head activation duration to said at least one thermal printer head to print a first line of indicia on said media;

advancing said media a predetermined distance, said indexing device sending an index signal to said control device once said media is advanced said predetermined distance;

recording the time elapsed between receipt of each index signals;

comparing said recorded time elapsed to a predicted time constant;

calculating a correction factor to adjust said duration of each print signal proportionally relative to said elapsed time between index signals; and sending a print signal having an adjusted print head activation duration to said at least one thermal print head to print a next line of indicia.

12. The method of controlling a thermal printer assembly of claim 11, wherein said correction factor is calculated using the following formula:

$$\text{Duration}_{new}=\text{Duration}_{old}*\{1+[((T_{cur}-T_{last})-P_{avg})/P_{avg}]*K\}$$

where $Duration_{new}$ represents the new strobe activation duration $Duration_{old}$ represents the original unmodified strobe activation duration $T_{cur}$ represents the recorded time elapsed before receiving the latest index signal from the encoder $T_{cur}$ represents the recorded time elapsed between the previous index signal from the encoder $P_{avg}$ represents the average time between encoder index signals K represents an empirically determined coefficient.

* * * * *